US006083180A

United States Patent [19]

Shimizu

[11] Patent Number: 6,083,180

[45] **Date of Patent: *Jul. 4, 2000**

[54] VIBRATOR-TYPE MASSAGING DEVICE

[75] Inventor: Nobuzo Shimizu, Higashi-Osaka, Japan

[73] Assignee: Daito Electric Machine Industry Company Limited, Osaka, Japan

[ * ] Notice: This patent is subject to a terminal disclaimer.

[21] Appl. No.: 09/122,106

[22] Filed: Jul. 24, 1998

Related U.S. Application Data

[63] Continuation of application No. 08/808,674, Feb. 28, 1997, Pat. No. 5,785,668, which is a continuation of application No. 08/505,279, Aug. 25, 1995, abandoned, which is a continuation of application No. PCT/JP94/01061, Jun. 30, 1994.

[30] Foreign Application Priority Data

Dec. 28, 1993 [JP] Japan ..... 5-338449

[51] Int. Cl.[7] ..... A61H 1/00

[52] U.S. Cl. ..... 601/50; 601/61; 601/86; 601/87; 601/95; 601/112; 601/134

[58] Field of Search ..... 601/28–31, 27, 601/22, 46, 49, 70, 86, 87, 50, 61, 95, 134, 112, 63, 65, 85

[56] References Cited

U.S. PATENT DOCUMENTS

| | | | |
|---|---|---|---|
| 2,781,040 | 2/1957 | Hill | 601/99 |
| 2,934,062 | 4/1960 | Klassen et al. | 601/61 |
| 2,964,037 | 12/1960 | Johnston | 601/94 |
| 3,055,357 | 9/1962 | Redka . | |
| 3,103,925 | 9/1963 | Vogt | 601/61 |
| 4,230,098 | 10/1980 | Uematsu | 601/99 |
| 4,414,963 | 11/1983 | Kunz | 601/134 |
| 4,860,734 | 8/1989 | Lyu | 601/98 |
| 5,063,911 | 11/1991 | Teranishi . | |
| 5,099,826 | 3/1992 | Hayakawa . | |
| 5,183,034 | 2/1993 | Yamasaki et al. | 601/113 X |
| 5,305,738 | 4/1994 | Shimizu | 601/35 |
| 5,356,369 | 10/1994 | Yamasaki et al. | 601/70 |

FOREIGN PATENT DOCUMENTS

| | | | |
|---|---|---|---|
| 6-096252 | 5/1985 | Japan . | |
| 2-6041 | 1/1990 | Japan . | |
| 4-026420 | 1/1992 | Japan . | |
| 40 5031150 | 2/1993 | Japan | 601/70 |
| 40 5049666 | 3/1993 | Japan | 601/112 |
| 40 5049667 | 3/1993 | Japan | 601/112 |
| 40 5184639 | 7/1993 | Japan | 601/89 |

OTHER PUBLICATIONS

Sharper Image, "Heating Foot Massager," p. 68, Jun. 1993 Catalog.

Hammacher Schlemmer, "Shiatsu Foot Massager," p. 47, Fall/Winter 1992 Catalog.

*Primary Examiner*—Danton D. DeMille

*Attorney, Agent, or Firm*—Birch, Stewart, Kolasch & Birch, LLP

[57] ABSTRACT

A massaging device is so arranged to allow a massaging member thereof to simultaneously perform a vibrating action and a kneading action on the same body part to be massaged, and not to require any increase in the size thereof. The present invention provides a vibrator-type massaging device including a casing and a vibrating plate provided on top of the casing so as to vibrate at a high speed. A massaging member is provided on the vibrating plate and includes a top surface serving as a contact surface for contact with a human body. A kneading means having a pair of kneading balls which swing in the same plane as that of the contact surface of the massaging member is provided inside the casing so as to knead a human body.

44 Claims, 5 Drawing Sheets

VIBRATOR-TYPE MASSAGING DEVICE

This application is a continuation of Ser. No. 08/808,674 filed Feb. 28, 1997 U.S. Pat. No. 5,785,668, which is a continuation of Ser. No. 08/505,279 filed Aug. 25, 1995 now abandoned, which is a continuation of PCT/JP94/01061 filed Jun. 30, 1994.

TECHNICAL FIELD

The present invention relates to vibrator-type massaging devices.

BACKGROUND ART

Conventionally, massaging devices for home use or for business use have been roughly divided into one of the following categories: kneading-ball type comprising a pair of kneading balls transversely mounted on a stationary housing so that they can swing; roller type comprising a plurality of massaging rollers disposed on a rotary table in the circumferential direction thereof; and vibrator type comprising a massaging member vibrating at a high speed and provided on one end of a casing which can be held with both hands.

To be more specific about the conventional vibrator-type massaging devices, a vibrating plate operable at a high speed is provided on top of the casing and the massaging member having a top surface for contact with a human body is secured to the top surface of the vibrating plate. Such a massaging device exerts massaging effects when the contact surface of its massaging member is pressed onto the back or other part of a user's body.

However, the conventional vibrator-type massaging devices provide only one type of massaging effects resulting from the vibrating of the massaging member, since the massaging member simply vibrates at a high speed. As a result, the conventional vibrator-type massaging devices have had difficulty in responding to the diversity of the user's tastes.

To overcome the above difficulty, the above vibrator-type massaging device can be adapted to have a kneading means comprising a pair of kneading balls transversely mounted on the outside of the massaging member. With the adaptation, however, the vibrating action and the kneading action cannot be obtained simultaneously in the same body part to be massaged, so that the combined massaging effects cannot be obtained. Moreover, the massaging device is disadvantageously increased in size.

In view of the foregoing situation, it is an object of the present invention to enable a massaging member to simultaneously perform a vibrating action and a kneading action on the same body part without upsizing a massaging device comprising the massaging member.

DISCLOSURE OF INVENTION

A vibrator-type massaging device of the present invention comprises: a casing 2; a vibrating plate 3 provided on top of the casing 2 so as to vibrate at a high speed; and a massaging member 4 provided on the vibrating plate 3 and having a top surface serving as a contact surface 28 for contact with a human body, wherein a kneading means 5 having a pair of kneading balls 13 which swing in the same plane as that of the contact surface 28 of the massaging member 4 is provided inside the casing 2 so as to knead a human body.

Since the pair of kneading balls 13 swing in the same plane as that of the contact surface 28 of the massaging member 4, they can knead the same part of the human body in which the massaging member 4 is performing a vibrating action simultaneously, thereby achieving massaging effects which respond to the diversity of the user's tastes.

Since the kneading means 5 is contained in the casing 2, the upsizing of the massaging device can be prevented.

In the vibrator-type massaging device of the present invention, the kneading means 5 comprises: a pair of flat gears 10 rotatably held by respective rotary shafts 9 and a pair of disk-shaped rotors 11 mounted don upper ends of the respective rotary shafts 9 so as to rotate together with the rotary shafts 9. The pair of kneading balls 13 are rotatably held around pivotal shafts 12 eccentrically installed on the top surfaces of the respective rotors 11. A drive motor 15 is provided having a worm gear 14 which meshes with each of the pair of flat gears 10 at a midpoint therebetween.

Consequently, rotational driving by the drive motor 15 causes the pair of flat gears 10 to rotate in opposite directions, while the left and right kneading balls 13 perform swinging movements (circular movements) in which they repeatedly come closer to and go further away from each other in synchronization.

In the vibrator-type massaging device of the present invention, the kneading means 5 is provided at a height such that a projecting portion of each of the kneading balls 13 penetrates the massaging member 4 and protrudes upwardly.

In the vibrator-type massaging device of the present invention, the vibrating plate 3 is held by buffer legs 16 at a given height relative to a base plate 6 screwed inside the casing 2, each of the buffer legs 6 is composed of a tubular body 17 made of rubber and a bolt 18, the tubular body 17 being interposed between the base plate 6 and the vibrating plate 3 and penetrated by the bolt 18 piercing both plates 6 and 3. Both ends of the bolt 18 piercing both plates 6 and 3 are screwed into nuts 19.

This enables the vibrating plate 3 to vibrate transversely in relation to the base plate 6.

In the vibrator-type massaging device of the present invention, a rotary shaft 21 of a drive motor 20 is connected to an eccentric shaft 22 having an axis eccentric with an axis of the rotary shaft 21, an upper end of the eccentric shaft 22 is fitted into a bearing 25, and the bearing 25 is pressed into a boss 26 formed on an undersurface of the vibrating plate 3.

Consequently, rotational driving by the drive motor 20 causes the vibrating plate 3 to vibrate at a high speed along the surface thereof.

In the vibrator-type massaging device of the present invention, the massaging member 4 is a rectangular board formed from a material such as rubber or resin and having a large number of thin projections 27 formed on a top surface thereof.

In the vibrator-type massaging device of the present invention, a base plate 6 screwed inside the casing 2, the vibrating plate 3, and the massaging member 4 are formed with openings 29, 30, and 31, respectively, which correspond to the reaches of swinging movements performed by the pair of kneading balls 13 of the kneading means 5.

Consequently, the kneading means 5 and jacking means 45 do not interfere with the base plate 6, with the vibrating plate 3, and with the massaging member 4.

In the vibrator-type massaging device of the present invention, a covering member 32 made of a woven fabric, a nonwoven fabric, a sponge sheet, a sheet material of rubber or resin, each having a certain degree of resilience or elasticity, is affixed to the opening 31 of the massaging member 4.

In the vibrator-type massaging device of the present invention, a length of that portion of each of the pair of kneading balls 13 protruding from the top surface of the massaging member 4 can be variably adjusted.

Consequently, the optimum condition can be achieved either in the case of using the massaging device for the back or in the case of using the massaging device for the sole (plantar arch).

In the vibrator-type massaging device of the present invention, the jacking means 45 comprises: a support plate 46 secured to a bottom of the casing 2, a pair of elevating arms 47 which are collapsible at midpoints, a threaded shaft 48 penetrating the pair of elevating arms 47 at the midpoints and held rotatable around its axis between the midpoints of the pair of elevating arms 47; and a drive motor 50 having a rotary gear 49 into which the threaded shaft 48 is screwed. Rotation of the drive motor 50 causes the threaded shaft 48 to rotate around its axis, expanding and contracting movements of the pair of elevating arms 47 causing the kneading means 5 to move upwardly and downwardly.

DETAILED DESCRIPTION OF THE PREFERRED EMBODIMENTS

Below, the embodiments of the present invention will be described with reference to the drawings.

Figure 1:
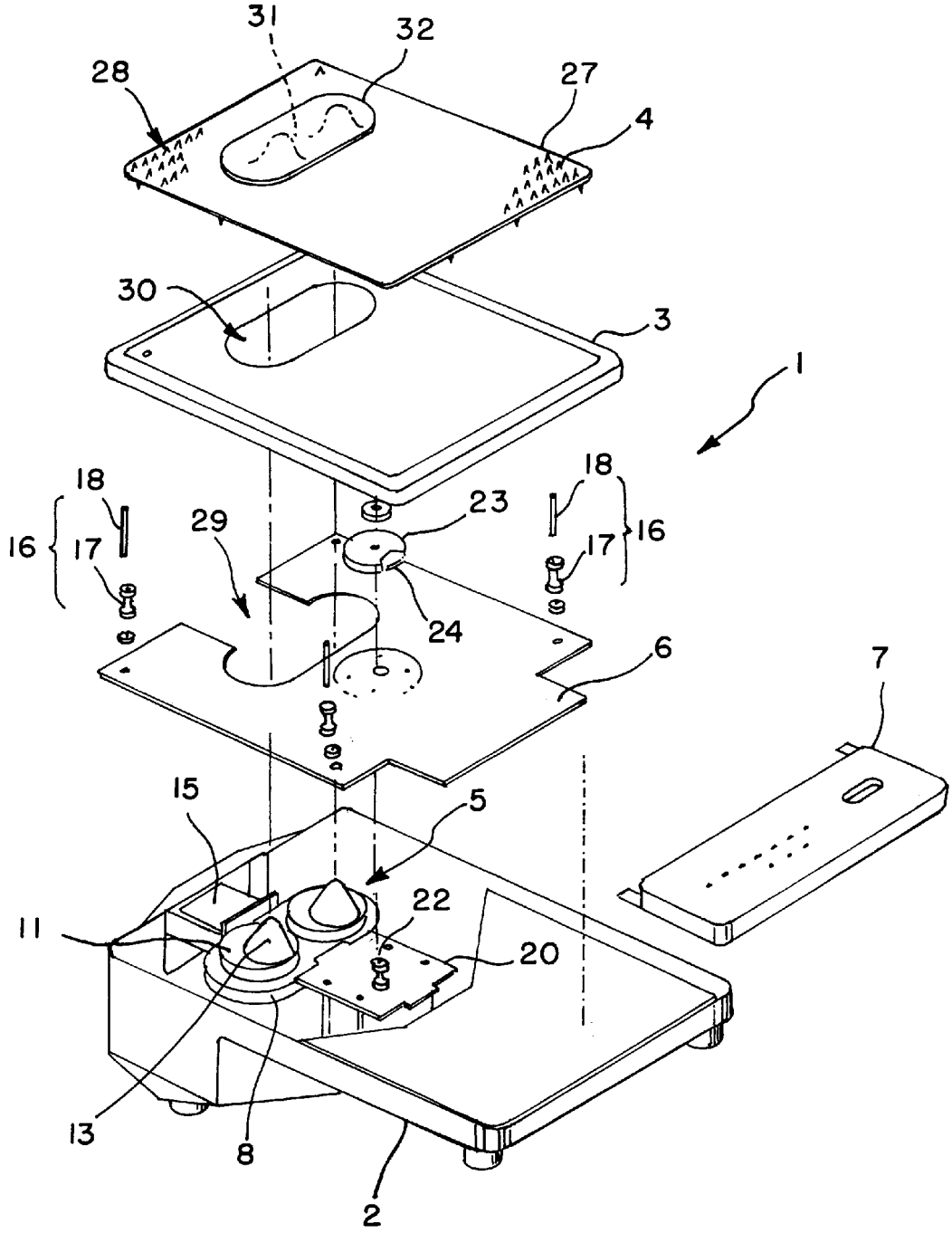
FIG. 1 is an exploded perspective view of a vibrator-type massaging device showing an embodiment of the present invention.
Figure 2:
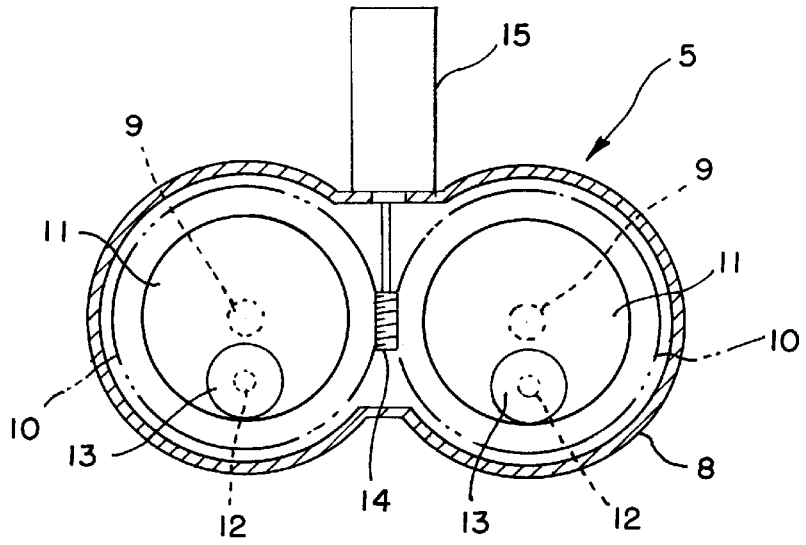
FIG. 2 is a plan view diagrammatically showing a kneading means of the embodiment shown in FIG. 1.
Figure 3:
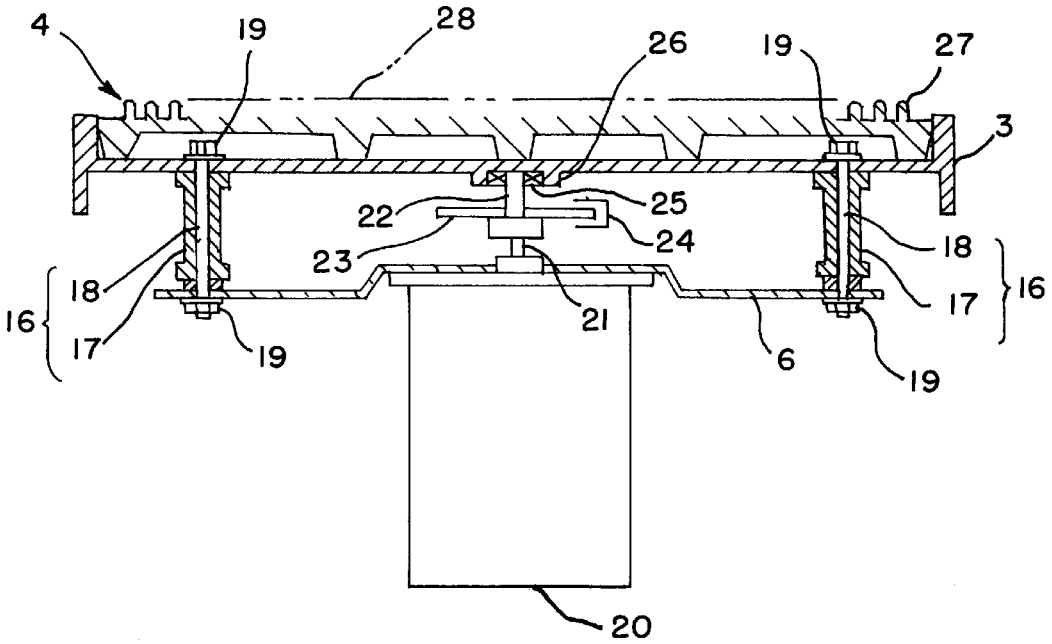
FIG. 3 is a front sectional view showing a driving mechanism of a vibrating plate of the embodiment shown in FIG. 1.

In FIGS. 1 to 3, a vibrator-type massaging device 1 according to the present embodiment comprises: a stationary casing 2 which is rectangular in cross section and formed thin at the front and thick at the rear. A vibrating plate 3 is mounted in a slanting position on top of the casing 2 so as to vibrate at a high speed. A massaging member 4 is secured to the top surface of the vibrating plate 3. A kneading means is contained in the above casing 2 in such a manner as to face upwardly from inside the top surface of the massaging member 4.

In the casing 2, the interior of the thick rear part is used as a space for containing respective driving elements of the above kneading means 5 and vibrating plate 3. The space is designed such that its top portion is covered with a base plate 6 screwed at appropriate portions inside the casing 2. The casing 2 and the base plate 6 form a support for the vibrating plate 3. The thin front part is designed such that an operator control panel 7 internally provided with a control circuit (not shown) is attached thereto.

As shown in FIG. 2, the above kneading means 5 consists of: a pair of left and right flat gears 10 rotatably held by respective rotary shafts 9 inside a gear case 8 and disk-shaped rotors 11 attached to the upper ends of the respective rotary shafts 9 are disposed within the gear case 8 so as to rotate together with the rotary shafts 9. Kneading balls 13 are rotatably held around respective pivotal shafts 12 which have been eccentrically installed on the top surfaces of the respective rotors 11; and a drive motor 15 having a worm gear 14 which meshes with each of the left and right flat gears 10 at a midpoint therebetween. The kneading means 5 is provided at a height such that the tip portions of the kneading balls 13 penetrate the massaging member 4 and protrude upwardly.

Accordingly, rotational driving by the drive motor 15 causes the left and right flat gears 10 to rotate in opposite directions, while the left and right kneading balls 13 perform swinging movements (circular movements) in which they repeatedly come closer to and go further away from each other in synchronization.

As shown in FIG. 3, the above vibrating plate 3 is held by four buffer legs 16 at a given height relative to the base plate 6. Each of the buffer legs 16 is composed of a tubular body 17 made of rubber, interposed between the base plate 6 and the vibrating plate 3, and penetrated by a bolt 18 piercing each of the plates 6 and 3. Both ends of the bolt 18 piercing the plates 6 and 3 are screwed into nuts 19. Consequently, the vibrating plate 3 can swing transversely in relation to the base plate 6 sufficiently to vibrate the base plate 3.

A drive motor 20 is mounted on the undersurface of the base plate 6. A rotary shaft 21 of the drive motor 20 is connected an eccentric shaft 22 having an axis eccentric with the axis of the rotary shaft 21. The eccentric shaft 22 is attached to a flywheel 23. An eccentric plum 24 is disposed in a position eccentric with the rotary shaft 21 and opposite to the eccentric shaft 22 with respect to the center of the rotary shaft 21.

The upper end of the eccentric shaft 22 is fitted into a bearing 25, which has been pressed into a boss 26 formed on the undersurface of the vibrating plate 3.

Accordingly, rotational driving by the drive motor 20 causes the vibrating plate 3 to vibrate at a high speed along the surface thereof.

The massaging member 4 is a rectangular board formed from a material such as rubber or resin. The top surface of the massaging member 4 is formed with a large number of thin projections 27. The projection portions of the projections 27 combine to constitute a plane, which serves as a contact surface 28 for contact with the human body. The massaging member 4 has ben secured to the top surface of the vibrating plate 3 by adhesion or by screwing. Alternatively, it is possible to use the massaging member 4 in which the heights of the projections 27 can be changed locally so as to intensely stimulate a given curing point of the human body. It is also possible to prepare different types of massaging members in which the projections 27 have different height distributions or no projection 27 is formed, so that a user can select from them a suitable one for a particular use and install it on the vibrating plate 3.

The above base plate 6, vibrating plate 3, and massaging member 4 are formed with openings 29, 30, and 31, respectively, which correspond to the reaches of the swinging movements (circular movements) performed by the left and right kneading balls 13 in the above kneading means 5. To the opening 31 of the massaging member 4 is affixed a covering member 32 made of a woven fabric, a nonwoven fabric, a sponge sheet, or a sheet material of rubber or resin, each of which has a certain degree of resilience or elasticity.

The control circuit (not shown) provided inside the operator control panel 7 is so constituted as to control the rotation of the drive motor 15 of the kneading means 5 and the rotation of the drive motor 20 of the vibrating plate 3. Since the present embodiment comprises the separate drive motors 15 and 20, the kneading means 5 and the vibrating plate 3 can be individually controlled. For example, it is possible to cause either one of the drive motors to perform rotational driving, to individually change the rotational speeds and driving cycles (repetition of rotation and halt) of the respective drive motors 15 and 20, and to switch between the forward rotation and backward rotation of the drive motor 15 of the kneading means 5 in a given cycle.

Figure 4:
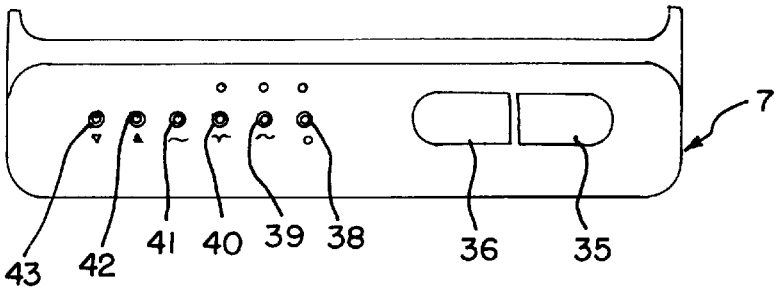
FIG. 4 is a plan view showing an operator control panel of the embodiment shown in FIG. 1.
Figure 5:
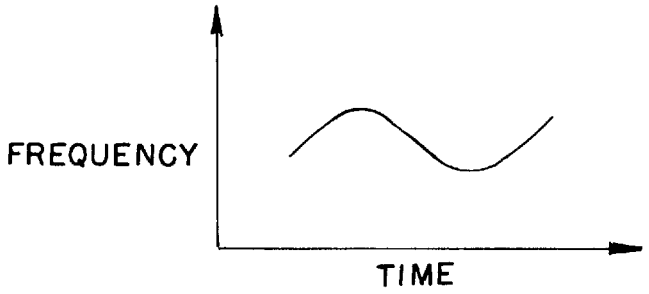
FIG. 5 is a graph showing a vibrating action of the vibrating plate.

As shown in FIG. 4, a vibrate key 35 and a knead key 36 are provided on the top surface of the above operator control panel 7. There are also provided a time extend key 38, a first wave key 39, a second wave key 49, a wave cancel key 41, an accelerate key 42, and a decelerate key 43. The control circuit in the above operator control panel 7 controls a drive motor 15 of the kneading means 5 and the drive motor 20 of the vibrate plate 3 as follows.

Specifically, if the user presses the time extend key 38, the state of the drive motor 20 of the vibrating plate 3 is sequentially switched from a halt to operation or from operation to a halt. If the user presses the knead key 36, on the other hand, the state of the drive motor 15 of the kneading means 5 is sequentially switched from a halt to driving or from driving to a halt. In this case, driving operation of the drive motor 20 or drive motor 15 is normally continued from 10 minutes and then automatically halted. If the user presses the time extend key 38 during the driving operation of the drive motor 20 or drive motor 15, the duration of the driving operation of the drive motor 20 or drive motor 15 can be extended up to 30 minutes.

Figure 6:
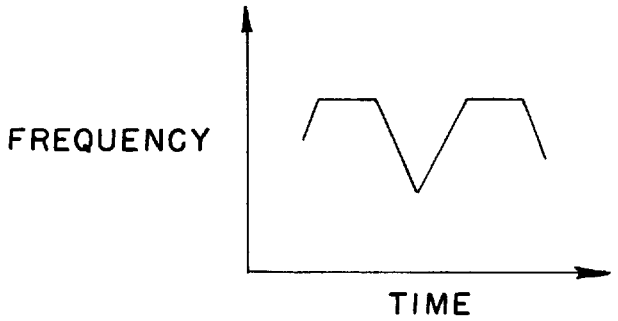
FIG. 6 is a graph showing the vibrating action of the vibrating plate.

If the user presses the first wave key 39 during the driving operation of the drive motor 20 of the vibrating plate 3, the rotational speed of the drive motor 20 is changed so that the oscillation frequency of the vibrating plate 3 changes to form a sinusoidal wave. If the user presses the second wave key 40 during the driving operation of the drive motor 20 of the vibrating plate 3, on the other hand, the rotational speed of the drive motor 20 is changed so that the oscillation frequency of the vibrating plate 3 changes to present the waveform shown in FIG. 6. If the user presses the wave cancel key 41 while the rotational speed of the drive motor 20 has been changed by the pressing of the first wave key 39 or second wave key 40, the rotation of the drive motor 20 is held at a speed at which the wave cancel key 41 was pressed, so that the vibrating plate 3 vibrates at a constant speed after the pressing of the wave cancel key 41.

If the user presses the accelerate key 42 during the driving operation by the drive motor 20 of the vibrating plate 3, the rotational speed of the drive motor 20 is increased stepwise on each pressing of the accelerate key 42. If the user presses the decelerate key 43 during the driving operation by the drive motor 20 of the vibrating plate 3, the rotational speed of the drive motor 20 is reduced stepwise on each pressing of the decelerate key 43.

Figure 7:
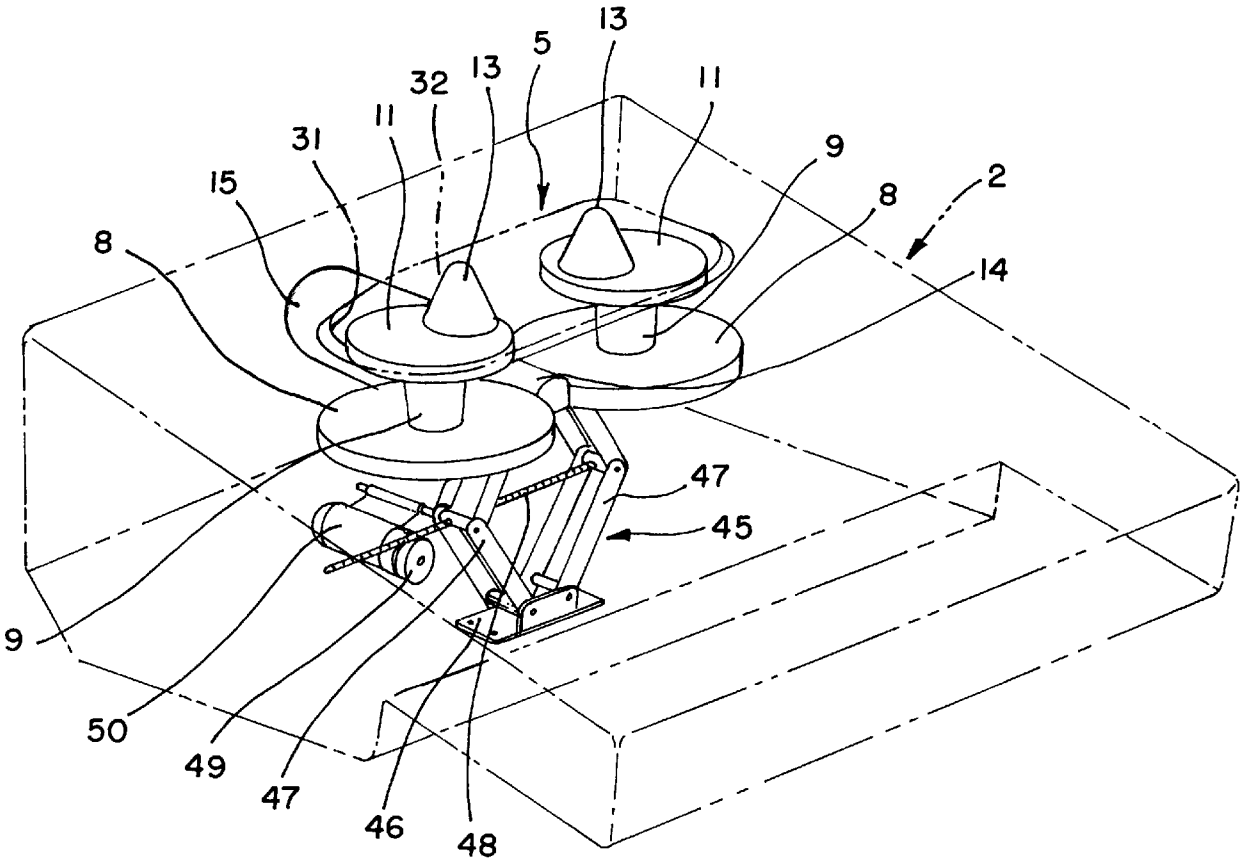
FIG. 7 is a perspective view showing another embodiment.
Figure 8:
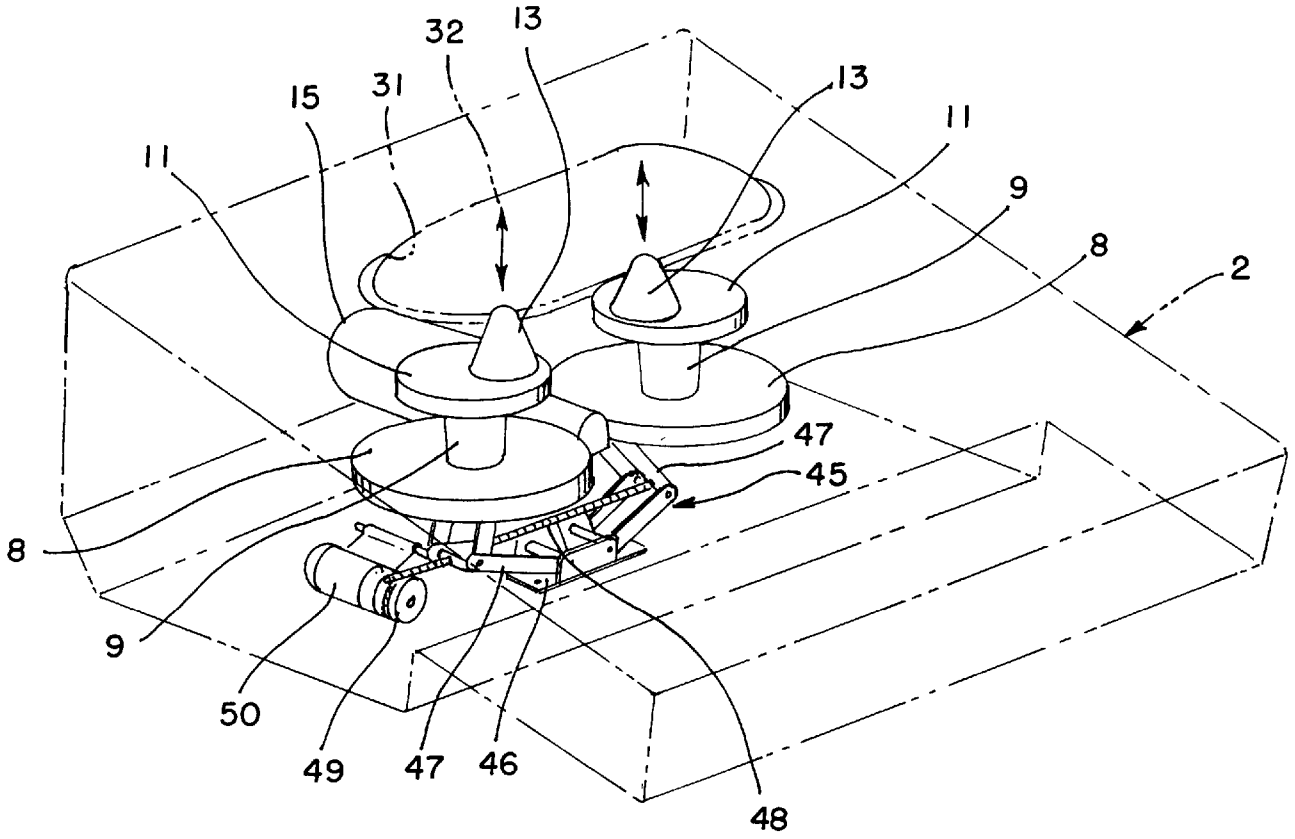
FIG. 8 is a perspective view showing the kneading means of another embodiment in a position after a descent.

FIGS. 7 and 8 show another embodiment, in which the kneading means 5 is supported by a jacking means 45 inside the casing 2 such that the kneading means 5 can move upward and downward, thereby variably adjusting the lengths of the those portions of the pair of kneading balls 13 projecting from the top surface of the massaging member 4. The above jacking means 45 comprises: a support plate 46 secured to the bottom of the casing 2; a pair of elevating arms 47 which are collapsible at midpoints; a threaded shaft 48 penetrating the pair of elevating arms 47 at the midpoints and held rotatable around its axis between the midpoints of the pair of elevating arms 47; and a drive motor 50 having a rotary gear 49 into which the threaded shaft 48 is screwed. Rotational driving by the drive motor 50 causes the threaded shaft 48 to rotate around its axis, whereby the pair of elevating arms 47 performs expanding and contracting movements and the kneading means 5 moves upwardly and downwardly accordingly. If the back of the human body is to be kneaded with the kneading means 5, the left and right kneading balls 13 are adjusted by the jacking means 45 so as to protrude upward to a height of about 30 to 40 mm from the top surface of the massaging member 4. If the sole of the human foot is to be kneaded with the kneading means 5, on the other hand, the left and right kneading balls 13 are adjusted by the jacking means 45 so as to protrude upward to a height of about 10 to 20 mm from the top surface of the massaging member 4. In this manner, the back and sole of the human body can be kneaded effectively. As for the other components of the present embodiment, they are the same as those of the above embodiment. Similarly to the above embodiment, the base plate 6 screwed inside the casing 2, the above vibrating plate 3, and the above massaging member 4 are formed with the openings 29, 30, and 31, respectively, which correspond to the reaches of the swinging movements performed by the left and right kneading balls 13 in the above kneading means 5. The present embodiment is so constituted that, even when the kneading means 5 is moved upwardly and downwardly by the jacking means 45, the kneading means 5 and jacking means 45 do not interfere with the base plate 6, with the above vibrating plate 3, and with the above massaging member 4.

In the present invention, it is possible to integrally form the vibrating plate 3 and the massaging member 4. It is also possible to constitute the massaging member 4 such that it has a smooth contact surface 28.

The casing 2 is not limited to any particular configuration. It is not limited to a stationary type, either.

If the kneading means 5 is so constituted that the height of those portions of the kneading balls 13 protruding from the opening 31 of the massaging member 4 can be adjusted, the optimum condition can be achieved either in the case of using the massaging device for the back and in the case of using it for the sole (plantar arch), which affords convenience to the user.

The massaging device of the present invention is useful in that the device can simultaneously perform the vibrating action and the kneading action on the same body part to be massaged, while the device has not been increased in size. The massaging device of the present invention is also useful in terms of its ability to respond to the diversity of the user's tastes.

What is claimed is:

1. A vibrator-type massaging device comprising:

a support;

a vibrating plate, said vibrating plate including at least one opening formed therein, said vibrating plate mounted for vibration relative to said support;

a massaging member provided on the vibrating plate and having a top surface for contacting a human body; and a pair of kneading balls mounted for swinging movement in a plane parallel to a plane of the top surface of the massaging member, said pair of kneading balls are mounted on the support for kneading the human body, at least a portion of said pair of kneading balls extends through said at least one opening formed in said vibrating plate.

2. The vibrator-type massaging device according to claim 1, further comprising kneading means, said kneading means including:

a pair of flat gears rotatably held by respective rotary shafts;

a pair disk-spaced rotors mounted on upper ends of the respective rotary shafts for rotating with the rotary shafts;

the pair of kneading balls rotatably held around pivotal shafts eccentrically installed on top surfaces on the respective rotors; and a drive motor having a worm gear meshing with each of the pair of flat gears at a midpoint there between.

3. The vibrator-type massaging device according to claim 1, wherein:

a projecting portion of each of the kneading balls penetrates the massaging member and protrudes upward.

4. The vibrator-type massaging device according to claim 1, further comprising:

buffer legs for mounting said vibrating plate in spaced relationship to said support, each of the buffer legs includes a tubular body made of rubber and a bolt, said tubular body being interposed between the support and the vibrating plate.

5. The vibrator-type massaging device according to claim 1, wherein an eccentric shaft connected to a rotary shaft of a drive motor includes an axis eccentric with an axis of the rotary shaft, an upper end of the eccentric shaft is fitted into a bearing, and the bearing is pressed into a boss formed on an undersurface of the vibrating plate.

6. The vibrator-type massaging device according to claim 1, wherein said massaging member is a rectangular board formed from rubber or resin and having a large number of thin projections formed on a top surface thereof.

7. The vibrator-type massaging device according to claim 1, wherein said support includes a casing and a base plate screwed inside the casing, said base plate and said massaging member each includes at least one opening which corresponds to the at least one opening formed in the vibrating plate.

8. The vibrator-type massaging device according to claim 7, wherein a covering member made of a woven fabric, a nonwoven fabric, a sponge sheet, or a sheet material made of rubber or resin, each having a certain degree of resilience or elasticity, is affixed to the at least one opening of the massaging member.

9. The vibrator-type massaging device according to claim 1, further comprising means to adjust an extent to which the kneading balls extend from the top surface of the massaging member.

10. The vibrator-type massaging device according to claim 1, further comprising:

kneading means including said pair of kneading balls; and a jacking means for supporting the kneading means for movement upward and downward inside the casing, wherein a length of a portion of each of said pair of kneading balls protruding from the top surface of the massaging member is variably adjustable by said jacking means.

11. The vibrator-type massaging device according to claim 9, wherein said support includes a casing and a base plate screwed inside the casing, said base plate and said massaging member each includes at least one opening which corresponds to the at least one opening formed in the vibrating plate.

12. The vibrator-type massaging device according to claim 10, said jacking means further comprising:

a support plate secured to a bottom of the casing thereof;

a pair of elevating arms collapsible at midpoints;

a threaded shaft penetrating the pair of elevating arms at the midpoints thereof, said threaded shaft rotatably mounted between the midpoints of the pair of elevating arms; and a drive motor having a rotary gear, said threaded shaft is threaded into the rotary gear, wherein rotational driving by the drive motor rotates the threaded shaft to expand and contract the pair of elevating arms to move the kneading means upward and downward.

13. The vibrator-type massaging device according to claim 10, wherein said support includes a casing and a base plate screwed inside the casing, said base plate and said massaging member each includes at least one opening which corresponds to the at least one opening formed in the vibrating plate.

14. The vibrator-type massaging device according to claim 13, said jacking means further comprises:

a support plate secured to a bottom of the casing;

a pair of elevating arms collapsible at midpoints thereof;

a threaded shaft penetrating the pair of elevating arms at the midpoints thereof, said threaded shaft rotatably mounted between the midpoints of the pair of elevating arms; and a drive motor having a rotary gear, said threaded shaft is threaded into the rotary gear, wherein rotational driving by the drive motor rotates the threaded shaft to expand and contract the pair of elevating arms to move the kneading means upward and downward.

15. The vibrator-type massaging device according to claim 4, wherein said support includes a casing and a base plate connected thereto, and said buffer legs interconnect the vibrating plate and the base plate.

16. The vibrator-type massaging device according to claim 4, wherein said support includes a casing and a base plate connected thereto, and said buffer legs interconnect the vibrating plate and the casing.

17. The vibrator-type massaging device according to claim 16, wherein said base plate interconnects the buffer legs to the casing.

18. A vibrator-type massaging device comprising:

a casing having an open top;

a vibrating plate provided generally on the open top of the casing, said vibrating plate including at least one opening formed therein, said vibrating plate mounted for vibration relative to said casing at a high speed;

a massaging member provided on the vibrating plate and having a top surface for contacting a human body; and a pair of kneading balls mounted for swinging movement in a plane parallel to a plane of the top surface of the massaging member, said pair of kneading balls is provided inside the casing for kneading the human body, at least a portion of said pair of kneading balls extends through said at least one opening formed in said vibrating plate.

19. The vibrator-type massaging device according to claim 18, further comprising kneading means, said kneading means including:

a pair of flat gears rotatably held by respective rotary shafts;

a pair disk-spaced rotors mounted on upper ends of the respective rotary shafts for rotating with the rotary shafts;

the pair of kneading balls rotatably held around pivotal shafts eccentrically installed on top surfaces on the respective rotors; and a drive motor having a worm gear meshing with each of the pair of flat gears at a midpoint therebetween.

20. The vibrator-type massaging device according to claim 18, wherein a projecting portion of each of the kneading balls penetrates the massaging member and protrudes upward.

21. The vibrator-type massaging device according to claim 1, further comprising:

a base plate secured to the casing;

buffer legs for mounting said vibrating plate in spaced relationship to said base plate, each of the buffer legs includes a tubular body made of rubber and a bolt, said bolt penetrating the tubular body and piercing the vibrating plate and the base plate.

22. The vibrator-type massaging device according to claim 18, wherein an eccentric shaft connected to a rotary shaft of a drive motor includes an axis eccentric with an axis of the rotary shaft, an upper end of the eccentric shaft is fitted into a bearing, and the bearing is pressed into a boss formed on an undersurface of the vibrating plate.

23. The vibrator-type massaging device according to claim 18, wherein said massaging member is a rectangular board formed from rubber or resin and having a large number of thin projections formed on a top surface thereof.

24. The vibrator-type massaging device according to claim 18, wherein a base plate is screwed inside the casing, said base plate and said massaging member each includes at least one opening which correspond to the at least one opening formed in the vibrating plate.

25. The vibrator-type massaging device according to claim 24, wherein a covering member made of a woven fabric, a nonwoven fabric, a sponge sheet, or a sheet material made of rubber or resin, each having a certain degree of resilience or elasticity, is affixed to the at least one opening of the massaging member.

26. The vibrator-type massaging device according to claim 18, further comprising means to adjust an extent to which the kneading balls extend from the top surface of the massaging member.

27. The vibrator-type massaging device according to claim 18, further comprising:

kneading means including said pair of kneading balls; and a jacking means for supporting the kneading means for movement upward and downward inside the casing, wherein a length of a portion of each of said pair of kneading balls protruding from the top surface of the massaging member is variably adjustable by said jacking means.

28. The vibrator-type massaging device according to claim 26, wherein a base plate is screwed inside the casing, said base plate and said massaging member each includes at least one opening which corresponds to the at least one opening formed in the vibrating plate.

29. The vibrator-type massaging device according to claim 27, said jacking means further comprising:

a support plate secured to a bottom of the casing thereof;

a pair of elevating arms collapsible at midpoints;

a threaded shaft penetrating the pair of elevating arms at the midpoints thereof, said threaded shaft rotatable mounted between the midpoints of the pair of elevating arms; and a drive motor having a rotary gear, said threaded shaft is threaded into the rotary gear, wherein rotational driving by the drive motor rotates the threaded shaft to expand and contract the pair of elevating arms to move the kneading means upward and downward.

30. The vibrator-type massaging device according to claim 27, wherein a base plate is screwed inside the casing, said base plate and said massaging member each includes at least one opening which corresponds to the at least one opening formed in the vibrating plate.

31. The vibrator-type massaging device according to claim 29, said jacking means further comprises:

a support plate secured to a bottom of the casing;

a pair of elevating arms collapsible at midpoints thereof;

a threaded shaft penetrating the pair of elevating arms at the midpoints thereof, said threaded shaft rotatably mounted between the midpoints of the pair of elevating arms; and a drive motor having a rotary gear, said threaded shaft is threaded into the rotary gear, wherein rotational driving by the drive motor rotates the threaded shaft to expand and contract the pair of elevating arms to move the kneading means upward and downward.

32. A vibrator-type massaging device comprising:

a casing;

a vibrating plate provided on a top of the casing, said vibrating plate mounted for vibration at a high speed;

a massaging member provided on the vibrating plate and having a top surface for contacting a human body;

a kneading means having a pair of kneading balls mounted for swinging movement in a plane parallel to a plane of the top surface of the massaging member, said kneading means is provided inside the casing for kneading the human body; and jacking means for supporting said kneading means for movement upward and downward inside the casing, wherein a length of a portion of each of said pair of kneading balls protruding from the top surface of the massaging member is variably adjustable by said jacking means.

33. The vibrator-type massaging device according to claim 32, said jacking means further comprising:

a support plate secured to a bottom of the casing;

a pair of elevating arms collapsible at midpoints thereof;

a threaded shaft penetrating the pair of elevating arms at the midpoints thereof, said threaded shaft rotatably mounted between the midpoints of the pair of elevating arms; and a drive motor having a rotary gear, said threaded shaft is threaded into the rotary gear, wherein rotational driving of the drive motor rotates the threaded shaft to expand and contract the pair of elevating arms to move the kneading means upward and downward.

34. The vibrator-type massaging device according to claim 32, wherein a base plate is screwed inside the casing, said base plate and said massaging member each includes at least one opening which corresponds to the at least one opening formed in the vibrating plate.

35. The vibrator-type massaging device according to claim 34, said jacking means further comprising:

a support plate secured to a bottom of the casing;

a pair of elevating arms collapsible at midpoints thereof;

a threaded shaft penetrating the pair of elevating arms at the midpoints thereof, said threaded shaft rotatably mounted between the midpoints of the pair of elevating arms; and a drive motor having a rotary gear, said threaded shaft is threaded into the rotary gear, wherein rotational driving of the drive motor rotates the threaded shaft to expand and contract the pair of elevating arms to move the kneading means upward and downward.

36. A vibrator-type massaging device comprising:

a support including:

a casing having an open top; and a base plate fixed to the casing, the base plate defining at least one first opening in a central portion thereof;

a vibrating plate disposed above the base plate in parallel, spaced-apart relation with the base plate, the vibrating plate defining at least one second opening at a location generally corresponding to the at least one first opening;

buffer legs interconnecting the vibrating plate and said support such that the vibrating plate is movable relative to the base plate in a plane in which the vibrating plate lies;

a vibration drive motor fixedly mounted on the underside of the base plate and having a drive shaft protruding upwardly from the base plate;

an eccentric shaft having a lower end eccentrically connected to the drive shaft and an upper end rotatably connected to the underside of the vibrating plate;

a pair of kneading balls disposed within the first and second openings so as not to come into contact with the peripheries of the first and second openings, wherein an upper portion of the kneading balls protrudes from the upper surface of the vibrating plate; and kneading means disposed within the casing for causing the kneading balls to perform a kneading operation within the first and second openings without being influenced by vibration of the vibrating plate.

37. The vibrator-type massaging device as set forth in claim 36, and further comprising a flat massaging member affixed to the upper surface of the vibrating plate and having a multiplicity of projections on the upper surface thereof.

38. The vibrator-type massaging device as set forth in claim 36, wherein the kneading means comprises:

a gear case disposed below the base plate and within the casing;

a pair of flat gears secured to corresponding rotary shafts vertically and rotatably disposed in the gear case;

a kneading drive motor fixed to a side of the casing and having a worm gear for meshing with each of the pair of flat gears at a position between the flat gears; and disk-shaped rotors secured to respective upper ends of the rotary shafts protruding upwardly from the upper surface of the gear case;

the kneading balls protruding from respective upper surfaces of the rotors at positions eccentric with respect to the corresponding rotary shafts.

39. The vibrator-type massaging device as set forth in claim 38, and further comprising elevating means for moving upwardly and downwardly the gear case so as to adjust the amount of protrusion of the kneading balls.

40. The vibrator-type massaging device as set forth in claim 39, wherein the elevating means comprises a pantograph-type jacking mechanism having a lower end fixed to the bottom of the casing and an upper end fixed to the underside of the gear case.

41. The vibrator-type massaging device as set forth in claim 36, wherein the second opening of the vibrating plate is closed with a cover member having elasticity and expansibility.

42. The vibrator-type massaging device according to claim 36, wherein said buffer legs interconnect the vibrating plate and the base plate.

43. The vibrator-type massaging device according to claim 36, wherein said buffer legs interconnect the vibrating plate and the casing.

44. The vibrator-type massaging device according to claim 43, wherein said base plate interconnects the buffer legs to the casing.

* * * * *